United States Patent [19]

Tsuzuki

[11] Patent Number: 4,632,383

[45] Date of Patent: Dec. 30, 1986

[54] TRAINING TOOL FOR PROMOTING GRIP

[75] Inventor: Kiyohiko Tsuzuki, Nagano, Japan

[73] Assignee: Kabushiki Kaisha Tsuzuki Seisakujo, Nagano, Japan

[21] Appl. No.: 571,669

[22] Filed: Jan. 17, 1984

[30] Foreign Application Priority Data

Jan. 21, 1983 [JP] Japan ..... 58-8943

[51] Int. Cl.[4] ..... A63B 5/00; A61B 5/22

[52] U.S. Cl. ..... 272/67; 272/DIG. 5; 73/379

[58] Field of Search ..... 272/67, 68, 93, 140, 272/141, 142, 134, 135, DIG. 5; 73/379, 380, 381; 116/300, 301, 304, 319, 320

[56] References Cited

U.S. PATENT DOCUMENTS

| | | | |
|---|---|---|---|
| 415,949 | 11/1889 | Soeding | 73/380 X |
| 468,154 | 2/1892 | McClure | 73/380 |
| 710,705 | 10/1902 | Mills | 73/381 |
| 1,487,631 | 3/1924 | Wanger | 272/68 |
| 3,511,097 | 9/1967 | Corwin | 272/DIG. 5 X |
| 3,647,209 | 3/1972 | LaLanne | 73/379 |
| 3,735,101 | 5/1973 | Stewart | 272/DIG. 5 X |
| 4,099,713 | 7/1978 | Spector | 272/DIG. 5 X |

FOREIGN PATENT DOCUMENTS

| | | | |
|---|---|---|---|
| 1215484 | 4/1960 | France | 272/141 |

*Primary Examiner*—Robert A. Hafer
*Assistant Examiner*—Kathleen D'Arrigo
*Attorney, Agent, or Firm*—Birch, Stewart, Kolasch & Birch

[57] ABSTRACT

A case of approximate sphere is formed by assembling a pair of hemispherical shell pieces with elastic materials. A rack, capable of shifting in the axial direction in connection with shift of the shell pieces, is supported within the case. A pinion designed to rotate in engagement with the rack is provided within the case. A grip indicator dial designed to rotate in connection with the pinion is provided within the case. This grip indicator dial is provided with a scale observable from outside the case. Within the case is provided a target-grip setting dial capable of being operated from outside the case. The target-grip setting dial is provided with a scale indicating the target-grip.

7 Claims, 6 Drawing Figures

TRAINING TOOL FOR PROMOTING GRIPcl

DESCRIPTION OF THE PRIOR ART

Several conventional training tools for promoting grip are known. The present inventor was granted a Japanese patent (Pat. No. 1166820) for a tool to be described below and now has a Japanese patent applied for a similar tool (Japanese Application No. 54-149854).

The above-specified tool is structured as follows: Two shell pieces facing each other are supported by a ring-form spring piece so as to be able to shift relatively to and from each other, and a tool suitable for being held by hand is made of the two shell pieces. For a force exerted upon the tool to be detected as an electrical signal, the spring piece has a strain gauge applied and a detector circuit is provided. An indicator circuit is provided which indicates the magnitude of the force exerted upon the tool by illuminating some of plural luminous elements set observable from outside the tool in proportion to the magnitude of a detector signal output from the detector circuit. A sounder circuit is provided which allows a sounder to operate when the magnitude of detector signal has reached a target value and which is designed so that the target value may be varied.

The above-described tool is convenient in that the user can know the progress of grip training. However, it has some disadvantages in that it is expensive since a number of luminous elements are needed to indicate the magnitude of grip applied, and in that faults are often encountered such as wire breakage due to repeated operations of pressing and releasing on the shell pieces since the internal mechanism is structured mostly with electric circuits.

SUMMARY OF THE INVENTION

The present invention was motivated by the above-mentioned situation with respect to the defective performance of the prior invention.

An object of the present invention is to offer a training tool for promoting grip which is simple, inexpensive, and sturdy, which allows the user to be aware of the grip being applied, thereby encouraging him to try to attain the target set, and which allows the user to increase the target value gradually, thereby leading him efficiently and continually to the final target value.

A further object of the present invention is to offer a training tool for promoting grip which is able to operate a buzzer, etc. to let the user know that the grip being applied has attained the set value.

A still further object of the present invention is to offer a training tool for promoting grip which is able to let the user know the progress in promoting grip during training by furnishing him with the information on the maximum value for repeatedly applied grips.

BRIEF DESCRIPTION OF THE DRAWINGS

The accompanying figures show a preferred embodiment of the present invention.

DESCRIPTION OF THE PREFERRED EMBODIMENT

Below will be explained in detail a preferred embodiment of the present invention by referring to the accompanying drawings.

Figure 1:
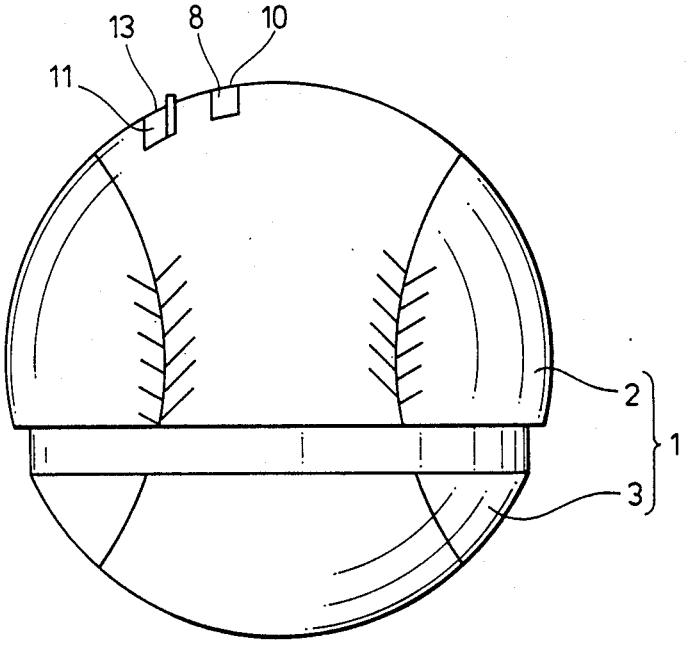
FIG. 1 is a front view.
Figure 2:
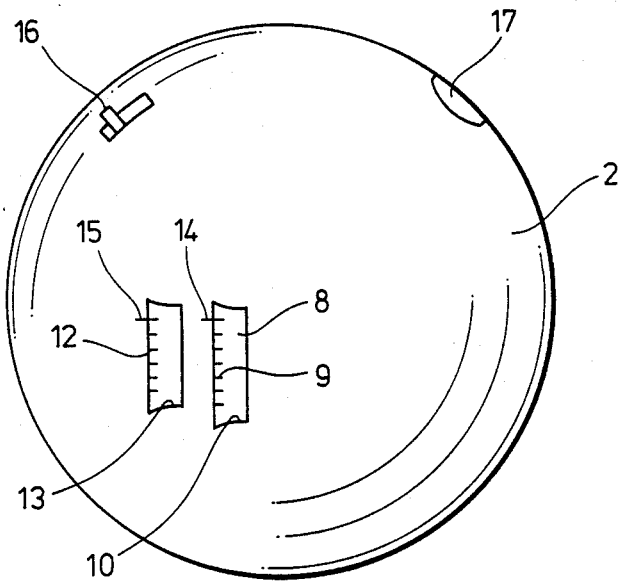
FIG. 2 is a plane view.
Figure 3:
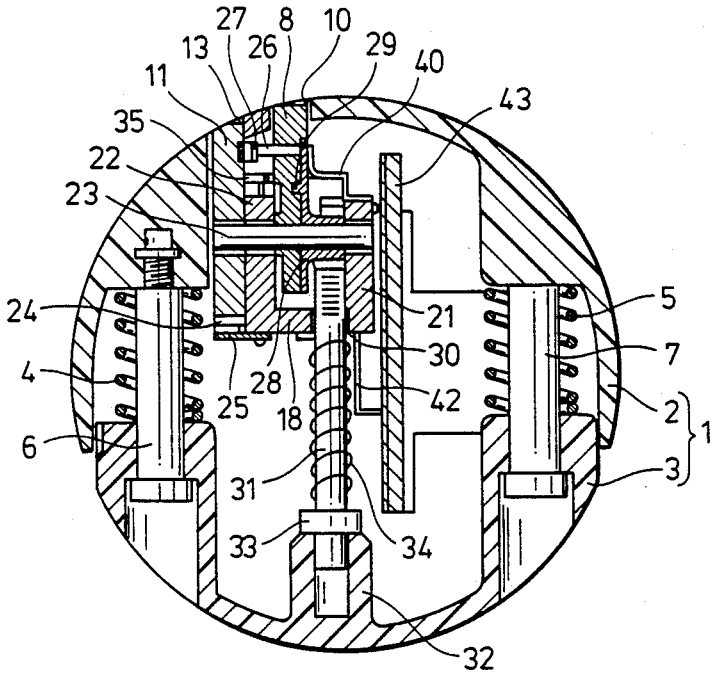
FIG. 3 is a partially-omitted front sectional view showing the inside of a case.

Referring to FIG. 1, a case 1, in the form of sphere, is composed of upper and lower shell pieces 2 and 3, both approximately in the form of hemisphere, which, with their open sides facing each other, which are assembled by means of coil springs 4 and 5 and bolts 6 and 7 as shown in FIG. 3. This structure allows the lower shell piece 3 to be guided by the bolts 6 and 7 so as to shift toward the upper shell piece 2 against the elastic force of coil springs 4 and 5 and return to its original position by the elastic force of the same springs. Referring to FIG. 2, the upper shell piece 2 is provided with two windows 10 and 13 in parallel: the window 10 is used to observe a scale 9 marked on a part of the peripheral side of a grip indicator dial 8; the window 13 used is to observe a scale 12 marked on a part of the peripheral side of a target-grip setting dial 11 as well as to operate the dial 11. These windows 10 and 13 have, at one of their respective shorter edges, reference marks 14 and 15, respectively. The upper shell piece 2 has an on-off-switch operating button 16, to be described later, projecting and is also provided with a confirmation window 17 for checking the number of grippings executed.

Figure 4:
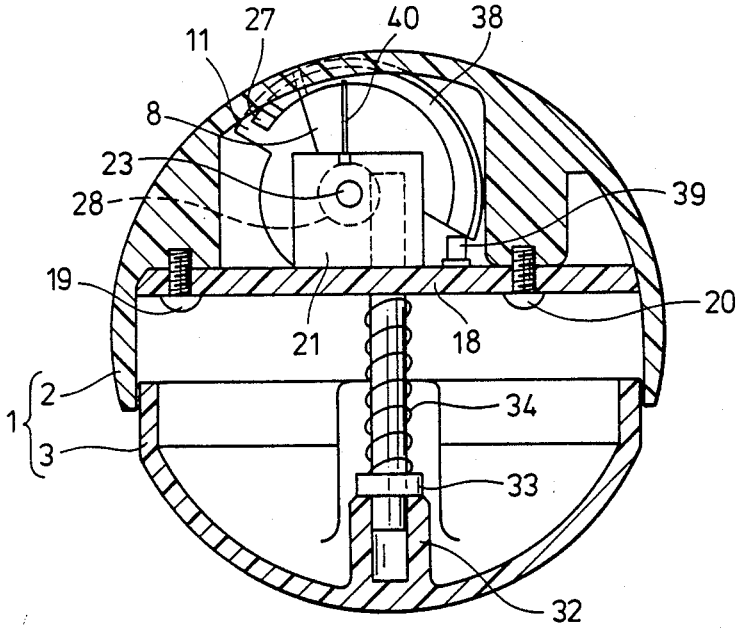
FIG. 4 is a side sectional view similar to FIG. 3.
Figure 5:
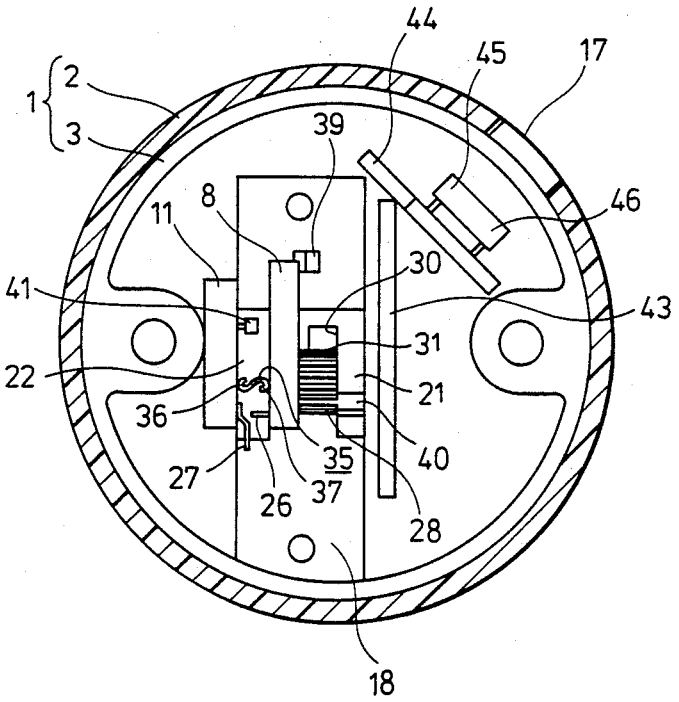
FIG. 5 is a traverse sectional view similar to FIG. 3.

Referring to FIGS. 3 and 5, a bracket 18 is fixed on the upper shell piece 2 by screws 19 and 20, and a shaft 23 is fixed on the pair of projected parts 21 and 22 of the bracket 18. The shaft 23 supports rotatably the target-grip setting dial outside the projected part 22. The scale 12, which is provided on a part of the peripheral side of target-grip setting dial 11 to indicate the target-grip value, can be observed through the window 13 as already mentioned. The target-grip setting dial 11 has a gear section 24 formed on a part of its peripheral side and this gear section 24 is caught by a positioning stopper 25 screwed under the bracket 18. The shaft 23 supports rotatably the grip indicator dial 8 inside the projected part 21. The scale 9, which is provided on a part of the peripheral side of grip indicator dial 8 to indicate the value of grip exerted onto the case 1, can be observed through the window 10 as already mentioned. The grip indicator dial 8 has, at a position near its peripheral side, a conductive contactor 26 penetrating in the thickness direction and fixed. The target-grip setting dial has an elastic, conductive piece 27 provided in such a way that the contactor 26 is always on the conductive piece 27 as it moves with the rotation of grip indicator dial 8. The conductive piece 27 is designed to shift farther away the contactor 26 as higher values of the scale 12 on the target-grip setting dial 11 are brought on the reference mark 15; the contactor 26 moving with the rotation of grip indicator dial 8 will come into contact with the conductive piece 27 when the value of scale 9 on the reference mark 14 for the grip indicator dial 8 has coincided with the value of scale 12 on the reference mark for the target-grip setting dial 11. The shaft 23 supports rotatably a pinion 28 inside the projected part 21, and this pinion 28 is designed to rotate in connection with the grip indicator dial 8 by fixing a pin 29, projecting from the peripheral edge of pinion 28, onto the grip indicator dial 8. The pinion 28 engages a rack 31 extending through a through-hole 30 on the bracket 18; this rack 31 is supported by the support base 32 on the lower shell piece 3 and is energized toward the support base 32 by means of a coil spring 34 applied between its collar 33 and the bracket 18. With such an arrangement, approach of the lower shell piece 3 to the upper shell piece 2 will move the rack 31 relative to the pinion 28 upward in FIG. 3, causing the pinion 28 to rotate in proportion to the shift distance of rack 31, i.e., to the grip exerted onto the case 1, and in turn causing the grip indicator 8 to rotate in the same degree of rotation with the pinion 28. For this rotation, the value of scale 9 on the reference mark is designed to be equal to the grip exerted. In FIGS. 3 and 5, a brake piece 35, which is approximately in an S form and has elastic pieces 36 and 37 at both ends of the S form (see FIG. 5), is screwed on the top of the projected part 22 of bracket 18 so that the elastic pieces 36 and 37 are in pressurized contact with the target-grip setting dial 11 and the grip indicator dial 8, respectively. The braking force of this brake piece 35 is set larger than the energizing force of the coil spring 34, so that, when the case 1 has been under application followed by release of a grip, the brake piece 35 will prevent the grip indicator dial 8 from returning to the original position after having rotated maximally, leaving the maximum value of grip on the scale 9. This brake piece 35 is designed to be capable of being kept released with a release lever, not shown, and usually continuous grip training is conducted with the brake piece 35 kept released. Referring to FIG. 4, an arc-like conductive plate 38 fixed on one side face of the grip indicator dial 8 is electrically in contact with the contactor 26 and is also in contact with an elastic contactor piece 39 screwed on the upper face of bracket 18 in the original state, i.e., non-grip state. The conductive plate 38 is in constant contact with the free end of a brush 40 screwed on the projected part 21 of bracket 18. The target-grip setting dial 11 is provided with an arc-like conductive plate (not shown) connected to the conductive piece 27, and this conductive plate, as seen from FIG. 5, is in constant contact with an elastic contactor piece 41 screwed on the top of the projected part 22 of bracket 18. As seen from FIG. 3, a support plate 42 is fixed on the bottom face of bracket 18 and this support plate 42 holds a base board 43 equipped with IC circuits to be described later. As shown in FIG. 5, another base board 44 is provided at an angle of ca. 45° to the base board 43, and on this base board 44 there are placed in parallel two common indicating elements 45 and 46 of seven segments at a position corresponding to the confirmation window 17. The indicating elements 45 and 46 will give 2-digit digital indication of the number of grips exerted on the case 1. The brush 40, elastic pieces 39 and 41, IC circuits on the base board 43, and indicating elements 45 and 46 on the base board 44 constitute an electric circuit together with an on-off switch, a piezo-electric buzzer, and a power supply battery, shown in FIG. 6 and to be described later; the electric circuit effects the operation of the piezo-electric buzzer and indicating elements 45 and 46 in response to the grip operation on the case 1.

Figure 6:
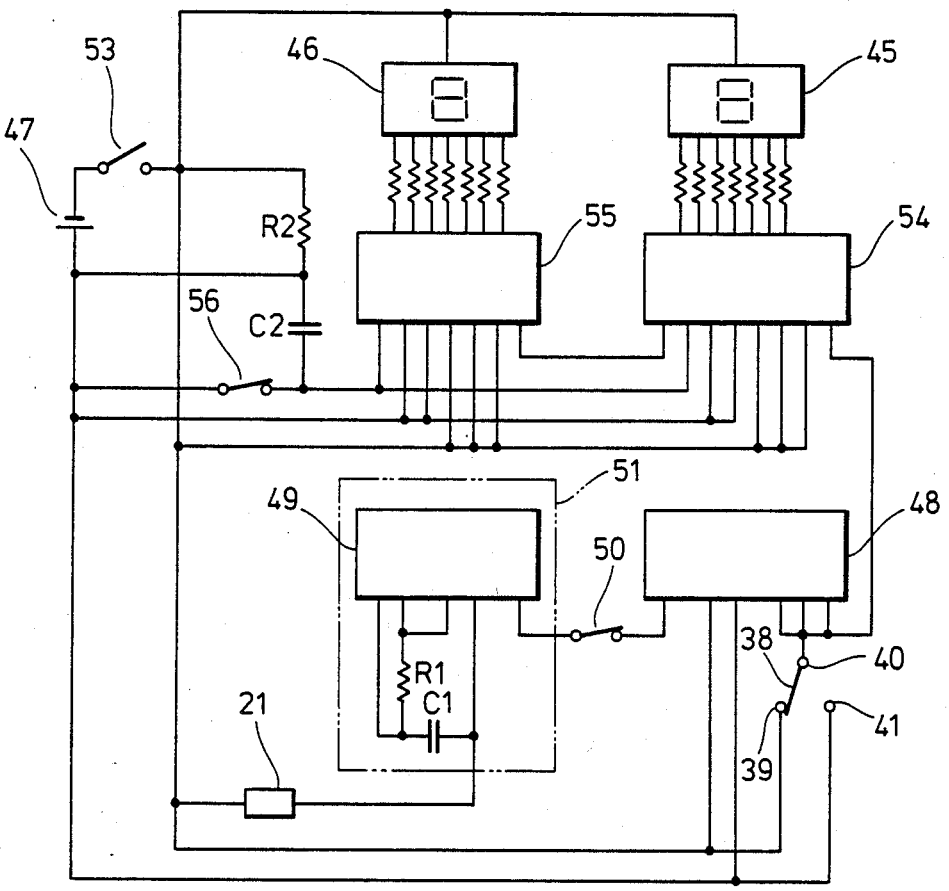
FIG. 6 is a circuit diagram for the electric circuit provided within the case.

The electric circuit shown schematically in FIG. 6 will be explained below by beginning with the sounder circuit. The plus terminal of a power supply battery 47 is connected to the elastic contactor piece 41 and the minus terminal to the elastic contactor piece 39 via an on-off switch 53. In the original state, as already mentioned, the elastic contactor piece 39 is in contact with the conductive plate 38 on the grip indicator dial 8. This conductive plate 38 is in constant contact with the brush 40, which is in turn connected to an IC amplifying circuit 48 which is composed of buffer ICs provided on the base board 43. With this configuration, when a grip is exerted on the case 1, the grip indicator dial 8 is caused to rotate until the contactor 26 is brought into contact with the conductive piece 27, with resulting connection of the conductive plate 38 to the elastic contactor piece 41; when the grip gets released, the grip indicator dial 8 is allowed to return to the original position with the conductive plate 38 returned to get into contact with the elastic contactor piece 39. Thus, in one cycle of application followed by release of a grip, the contactor 26, when brought into contact with the conductive piece 27, will send one pulse wave to the IC amplifying circuit 48; this pulse wave is amplified and output from the amplifying circuit 48. One of the output pins on the IC amplifying circuit 48 is connected, via a switch 50, to one of the input pins of an inverter 49 provided on the base board 43. This inverter 49, together with externally-provided resistor R1 and condenser C1, constitutes an IC oscillator circuit 51, whose output side is connected to an on-off switch 53 via a piezo-electric buzzer 52. With this structure, when the IC amplifying circuit 48 outputs a pulse wave to the IC oscillator circuit 51 while the switch 50 is on, this pulse wave sent will activate the IC oscillator circuit 51, with resulting operation of the piezo-electric buzzer 52. The switch 50, not shown in any of FIGS. 1–5, while in its off state, will break the above-specified output from the IC amplifying circuit 48 to the IC oscillator circuit 51 and pass the output to only an IC counter to be described below; the switch 50 is usually kept on. We now turn to the IC counter circuit. The base board 43 is provided with IC counters 54 and 55. The input pin of the IC counter 54 is connected to one of the output pins of IC amplifying circuit 48 and its carry-over pin is connected to the input pin of IC counter 55. IC counters 54 and 55, having their output pins connected, respectively, to the 7-segment indicating elements 45 and 46 provided on the base board 44, will count the number of pulses output from the IC amplifying circuit 48, outputting count signals to the indicating elements 45 and 46 for 2-digit decimal indication. The IC counters 54 and 55 have their pins connected to the power supply battery 47 via a resistor R2, a condenser C2, and the on-off switch 53; this on-off switch 53, when caused to get into its ON-state, will instantaneously apply a plus voltage upon the reset pins to make the reset state with the IC counters 54 and 55. Also, the IC counters 54 and 55 are designed to be brought into reset state even while the on-off switch is in ON state, if a push-button switch 56 (not shown in any of FIGS. 1–5) is caused to make an ON-operation when their reset pins have been connected to the power supply battery 47 via the push-button switch 56.

In using the above-described example tool, first a desired value on the scale 12 of target-grip setting dial 11 is set to the reference mark 15 and then a grip is applied on the case 1 so that both the upper and lower shell pieces 2 and 3 approach each other. The grip indicator dial 8 is caused to rotate in proportion to the grip exerted on the case 1 and the value of the grip may be confirmed by observing through the window 8 the value of the scale 9 which has fallen on the reference mark 14. In this stage, if the value of scale 9 has exceeded the previously-set set value of the scale on the target-grip setting dial 11, the contactor 26 is brought into contact with the conductive piece 27 and thus the piezo-electric buzzer 52 is caused to operate to make it known that the grip has reached the desired target value and at the same time the indicating elements 45 and 46 are caused to operate to indicate the number of the successful grips.

The present invention has many advantages in that, since the user can confirm his applied grip and can be made known by the sounder of the attainment of the target grip, the user can execute training efficiently by applying proper grips, can be encouraged to continue training by giving variation to monotomous training, and can easily attain the target grip, that the tool can be manufactured at low cost since the indication of grip value is effected by a simple structure which uses the combination of rack and pinion to rotate the grip indicator dial, and that the case is formed in an approximate sphere to facilitate gripping by hand.

The present invention has been explained in detail in reference to a preferred embodiment; it is not, of course, limited to the embodiment but a wide range of variation may be applied within the scope of the spirit of invention. For example, instead of the sounder using an audible piezo-electric buzzer, use may be made of visible luminous substances, and various kinds of circuits may be used to operate the sounder.

I claim:

1. A training tool for promoting grip characterized in that it comprises:

a case of approximately spherical shape constituted by a pair of shell pieces of approximately hemispherical shape positioned with their open sections facing each other and connected with each other by elastic materials so as to be able to shift relatively to each other and to return to the original position by spring action;

a pair of windows which are located parallel to each other on the surface of said spherical case;

a rack which is supported to one of said shell pieces within said case so as to be able to shift in the axial direction in connection with the relative shift of said shell pieces;

a pinion which is caught by said rack so as to be able to rotate within said case;

a grip indicator dial which is supported within said case rotatably in connection with said pinion, said dial has a circular face positioned under one of said pair of windows, and a grip-scale provided on said circular face so that said scale may be read through said window;

a target-grip setting dial which is provided parallel to said grip indicator dial within said case so as to be held at any prescribed rotational position, said setting dial has a circular face positioned under the other of said pair of windows, and has a target-grip scale provided on said setting dial circular face; and an informer circuit which comprises a conductive contactor piece positioned on said grip indicator dial and a conductive piece positioned on said target-grip setting dial so as to be brought into contact with said contactor piece when said pair of shell pieces have been appropriately shifted toward each other, said circuit is capable of being put into operation when said contactor piece has come into contact with said conductive piece.

2. A training tool for promoting grip according to claim 1, wherein both said grip indicator dial and said target-grip setting dial are supported rotatably on a common shaft which is fixed on a pair of projected parts extending from a bracket fixed within said case.

3. A training tool for promoting grip characterized in that it comprises:

a case of approximately spherical shape constituted by a pair of shell pieces of approximately hemispherical shape positioned with their open sections facing each other and connected with each other by elastic materials so as to be able to shift relatively to each other and to return to the original position by spring action;

a pair of windows which are located parallel to each other on the surface of said spherical case;

a rack which is supported on one of said shell pieces within said case so as to be able to shift in the axial direction in connection with the relative shift of said shell pieces;

a pinion which is caught by said rack so as to be able to rotate within said case;

a grip indicator dial which is supported within said case rotatably in connection with said pinion, said dial has a circular face positioned under one of said pair of windows, and a grip-scale provided on said circular face so that said scale may be read through said window;

a target-grip setting dial which is provided parallel to said grip indicator dial within said case so as to be held at any prescribed rotational position, said setting dial has a circular face positioned under the other of said pair of windows, and has a target-grip scale provided on said setting dial circular face;

an informer circuit which comprises a conductive contactor piece positioned on said grip indicator dial and a conductive piece positioned on said target-grip setting dial so as to be brought into contact with said contactor piece, said circuit is capable of being put into operation when said contactor piece has come into contact with said conductive piece;

said informer circuit further comprises an arc-like conductive plate positioned on the side of said grip indicator dial so as to be conductive to said contactor piece, and a fixed brush piece in sliding contact with said arc-like conductive plate.

4. A training tool for promoting grip according to claim 3, wherein said target-grip setting dial comprises a gear section provided on a portion of said circular face thereof and a stopper piece, and said setting dial is capable of being held at any prescribed positions by means of engagement between said gear section and said stopper piece.

5. A training tool for promoting grip according to claim 4, wherein said rack is set on a support provided on one of said pair of shell pieces so as to be capable of traveling in the axial direction relative to said shell pieces, and a brake piece is provided which is in elastic contact with the side of said grip indicator dial so as to stop said grip indicator dial at the rotational positioned attained.

6. A training tool for promoting grip characterized in that it comprising:

a case of approximately spherical shape constituted by a pair of shell pieces of approximately hemispherical shape positioned with their open sections facing each other and connected with each other by elastic materials so as to be able to shift relatively to each other and to return to the original position by spring action;

a pair of windows which are located parallel to each other on the surface of said spherical case;

a rack which is supported on one of said shell pieces within said case so as to be able to shift in the axial direction in connection with the relative shift of said shell pieces;

a pinion which is caught by said rack so as to be able to rotate within said case;

a grip indicator dial which is supported within said case rotatably in connection with said pinion, said dial has a circular face positioned under one of said pair of windows, and a grip-scale provided on said circular face so that said scale may be read through said window;

a target-grip setting dial which is provided parallel to said grip indicator dial within said case so as to be held at any prescribed rotational position, said setting dial has a circular face positioned under the other of said pair of windows, and has a target-grip scale provided on said setting dial circular face; and a counter circuit which comprises a conductive contactor piece positioned on said grip indicator dial and a conductive piece positioned on said target-grip setting dial so as to be brought into contact with said contactor piece, and said circuit is capable of being put into operation when said contactor piece has come into contact with said conductive piece, thus counting the number of training trials successful in reaching the target grip value.

7. A training tool for promoting grip according to claim 6, wherein said counter circuit further comprises an arc-like conductive plate positioned on the side of said grip indicator dial so as to be conductive to said contactor piece, and a fixed brush piece in sliding contact with said arc-like conductive plate.

* * * * *